United States Patent [19]

Force

[11] Patent Number: 4,919,554

[45] Date of Patent: Apr. 24, 1990

[54] CRUSH ROLLER ASSEMBLY FOR A SCREEN PROCESS PRINTING MACHINE

[75] Inventor: George H. Force, Huntington Beach, Calif.

[73] Assignee: Ernst W. Dorn Co., Inc., Gardena, Calif.

[21] Appl. No.: 309,140

[22] Filed: Feb. 13, 1989

[51] Int. Cl.[5] ..... B41K 35/00

[52] U.S. Cl. ..... 400/419; 400/425; 15/256.52

[58] Field of Search ..... 101/491, 416.1, 423, 101/424, 424.2, 425, 417, 416; 15/256.52, 105, 106

[56] References Cited

U.S. PATENT DOCUMENTS

| | | | |
|---|---|---|---|
| 2,593,478 | 4/1952 | Newton | 15/256.52 |
| 3,217,646 | 11/1965 | Sharkey | 101/425 |
| 3,604,239 | 9/1971 | Moxon | 101/425 |
| 3,763,778 | 10/1973 | Sills et al. | 101/425 |
| 3,898,929 | 8/1975 | Arild et al. | 101/425 |
| 4,082,037 | 4/1978 | Grindley et al. | 101/425 |
| 4,093,369 | 6/1978 | Hewitt | 15/256.52 |
| 4,113,376 | 9/1978 | Rodda | 15/256.52 |
| 4,187,425 | 1/1980 | Higaya et al. | 101/425 |

FOREIGN PATENT DOCUMENTS

| | | | |
|---|---|---|---|
| 2552725 | 6/1977 | Fed. Rep. of Germany | 101/417 |
| 3700603 | 8/1987 | Fed. Rep. of Germany | 101/425 |
| 104973 | 6/1984 | Japan | 101/425 |
| 257853 | 11/1987 | Japan | 101/425 |

*Primary Examiner*—Eugene H. Eickholt
*Attorney, Agent, or Firm*—Leonard Tachner

[57] ABSTRACT

A calendering and brush roller assembly that may be easily integrated into a screen process printing machine and which utilizes a novel vacuum cleaning system in combination with brush rollers which not only removes the agglomerated lithographic powder from the printing stock but also removes the powder from the crush roller assembly to either minimize or entirely obviate the requirement for frequent periodic cleaning of the assembly. The crush roller assembly of the present invention is designed to crush litho printing powder normally used to dry ink. The powder otherwise interferes with coating applied to printed material to provide a durable surface such as on magazine covers and colored posters. If the powder is not either wiped off or crushed before the coating is applied, the result is the formation of bumps of agglomerations which make the coating surface rough and interferes with the desired glossy surface. The crush roller assembly of the present invention comprises two crushing rollers and two brush rollers. A lower crush roller is driven and is a chrome plated steel roller. The upper crush roller is meshed by gears to the lower crush roller and is also a chrome plated steel roller and is moveable in a vertical direction to be selectively engageable with the lower crush roller. A brush roller is associated with each such crush roller and is designed to wipe the powder off the crush rollers. The crush roller assemly is contained within a selectively openable safety housing which is also designed to substantially enclose the roller assembly for permitting the application of a vacuum system, the intake portion of which comprises a pair of plenums having a series of apertures distributed in an array adjacent the brush roller for suctioning the crushed powder from the brush rollers.

6 Claims, 5 Drawing Sheets

CRUSH ROLLER ASSEMBLY FOR A SCREEN PROCESS PRINTING MACHINE

BACKGROUND OF THE INVENTION

1. Field of the Invention

The present invention relates generally to calender units that use crush rollers to crush powders and other superfluous materials on the surface of printing media and more specifically to a calender unit that combines crush rollers, brush rollers and a vacuum cleaning system for use in a screen process printing machine.

2. Prior Art

Calender rollers for cleaning or smoothing fabrics, print stock or other material are well known in the prior art. By way of example:

U.S. Pat. No. 3,991,669 to Cumbers is directed to a calender press wherein a complaint roll is in contact with a rigid roll. The calender press of this reference includes a rigid roll which is in contact along its length with a hollow, thin-walled compliant roll. The compliant roll deforms elastically due to its thin wall and hollow construction.

U.S. Pat. No. 4,498,383 to Pav et al is directed to a calender system wherein one of a pair of rolls has an external surface formed of a deformable, elastic substance. The calendar includes a rigid roll which contacts a roll comprising an elongated hollow cylindrical shell surrounded by an elastic liner. The liner may consist of any of a variety of materials which exhibit visco-elastic characteristics, like that of cast or extruded synthetic plastic, or natural or synthetic rubber.

U.S. Pat. No. 2,730,770 to Higginbotham et al is directed to clearing rolls for maintaining calender rolls in a clean condition. The clearing rolls are positioned so as to contact the pressure rolls of the illustrated machine. The clearing rolls are formed by a roll body of elastic material such as expanded rubber, and covered by a flock covering.

U.S. Pat. No. 1,911,930 to Schultze is directed to a cleaning device for use on machines with cylindrical rolls. The cleaning brush is moved over the stretching cylinders of a textile stretching machine. The machine also includes a cylindrical brush which cleans both the cleaning cylinder and the upper cylinders.

U.S. Pat. No. 4,510,864 to Klemm is directed to a screen printing machine having a drying path. The screen printer of this reference makes use of heated rollers to dry the ink, as opposed to using litho printing powder.

Screen process printing machines are also well known in the art. Typically, screen process printing machines serially feeds paper stock onto a roller where ink is applied to the stock through a screen of predetermined layout to deposit the ink in desired locations. When the stock is clean, that is the surface is free of any extraneous materials, the ink can be easily deposited in desired locations without any difficulty. However, there has recently been developed a relatively new use for screen process printing machines in which paper stock having lithographic powder on its surface is fed onto the roller. This new use is called a liquid lamination process and is employed for applying glossy film finishes or coatings to print stock. The screen process printing machine applies the chemical coating which is then cured, usually by the application of ultraviolet light to the coated stock. Unfortunately, the presence of such powders on the printing stock can detrimentally effect the coating deposition process particularly when such powders have agglomerated on the printed surface of the stock. As a result, the coating may be deposited over the agglomerations of lithographic powder thereby preventing the deposition from producing a smooth coated surface. Therefore, it is important to provide a means for allowing the use of lithographic powders on paper stock fed to a screen process cylinder while avoiding any such powder agglomerations on the stock before it reaches the coating deposition screen. Unfortunately, no prior art screen process printing machine known to the applicants herein has integrated a calender or crush roller unit into a screen process printing machine. Accordingly, it has been necessary to either carefully wipe clean every sheet of paper stock before it is fed to a screen process printing machine or attempt to minimize the application of lithographic powder to reduce interference with the coating process. Furthermore, merely adapting prior art calender roll assemblies of the known prior art to existing screen process printing machines would be extremely difficult, if not impossible without avoiding interference with the screen process printing machine feeding mechanism and without substantially increasing the maintenance requirements for frequent and periodic cleaning of the crush roller unit in order to keep the screen process printing machine working efficiently and effectively.

There has therefore been a long felt need for an integrated calender and brush roller unit and screen process printing machine which enables the use of lithographic powders on the printing stock while assuring that no powder agglomerations will be produced and which would otherwise interfere with the screen process coating performance. Furthermore, there has been a long felt need for such an integrated unit which does not substantially increase the maintenance requirements for the screen process printing machine as previously outlined.

SUMMARY OF THE INVENTION

The present invention solves the aforementioned long felt need by providing a calendering and brush roller assembly that may be easily integrated into a screen process printing machine and which utilizes a novel vacuum cleaning system in combination with brush rollers which not only removes the agglomerated lithographic powder from the printing stock but also removes the powder from the crush roller assembly to either minimize or entirely obviate the requirement for frequent periodic cleaning of the assembly. The crush roller assembly of the present invention is designed to crush litho printing powder normally used to dry ink. The powder otherwise interferes with coating applied to printed material to provide a durable surface such as on magazine covers and colored posters. If the powder is not either wiped off or crushed before the coating is applied, the result is the formation of bumps or agglomerations which make the coating surface rough and interferes with the desired glossy surface.

The crush roller assembly of the present invention comprises two crushing rollers and two brush rollers. A lower crush roller is driven and is a chrome plated steel roller. The upper crush roller is a chrome plated steel roller meshed by gears to the roller and is moveable in a vertical direction to be selectively engageable with the lower crush roller. A brush roller is associated with each such crush roller and is designed to wipe the powder off the crush rollers. The crush roller assembly is contained within a selectively openable safety housing which is also designed to substantially enclose the roller assembly for permitting the application of a vacuum system, the intake portion of which comprises a pair of plenums having a series of apertures distributed in an array adjacent the brush rollers for suctioning the crushed powder from the brush rollers thereby alleviating or substantially reducing the need for frequent periodic cleaning which would otherwise interfere with efficient operation of the screen process printing machine. The crush roller assembly of the present invention, particularly when integrated into a screen process printing machine, provides a novel and highly advantageous solution to the aforementioned long felt need. More specifically, the present invention makes possible use of ultraviolet clear coating liquid lamination processes where it was previously not possible or very difficult to do.

OBJECTS OF THE INVENTION

It is therefore a principal object of the present invention to provide a calendar unit for a screen process printing machine for use in crushing lithographic printing powder which might otherwise interfere with coating applied to cover printed material.

It is an additional object of the present invention to provide a unique calendar unit having an advantageous vacuum system for cleaning lithographic printing powder in a screen process printing machine.

It is still an additional object of the present invention to provide a crush roller assembly that may be integrated into a screen process printing machine and which provides a selectively openable safety housing for preventing injury and for reducing the maintenance associated with such assembly.

BRIEF DESCRIPTION OF THE DRAWINGS

The aforementioned objects and advantages of the invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
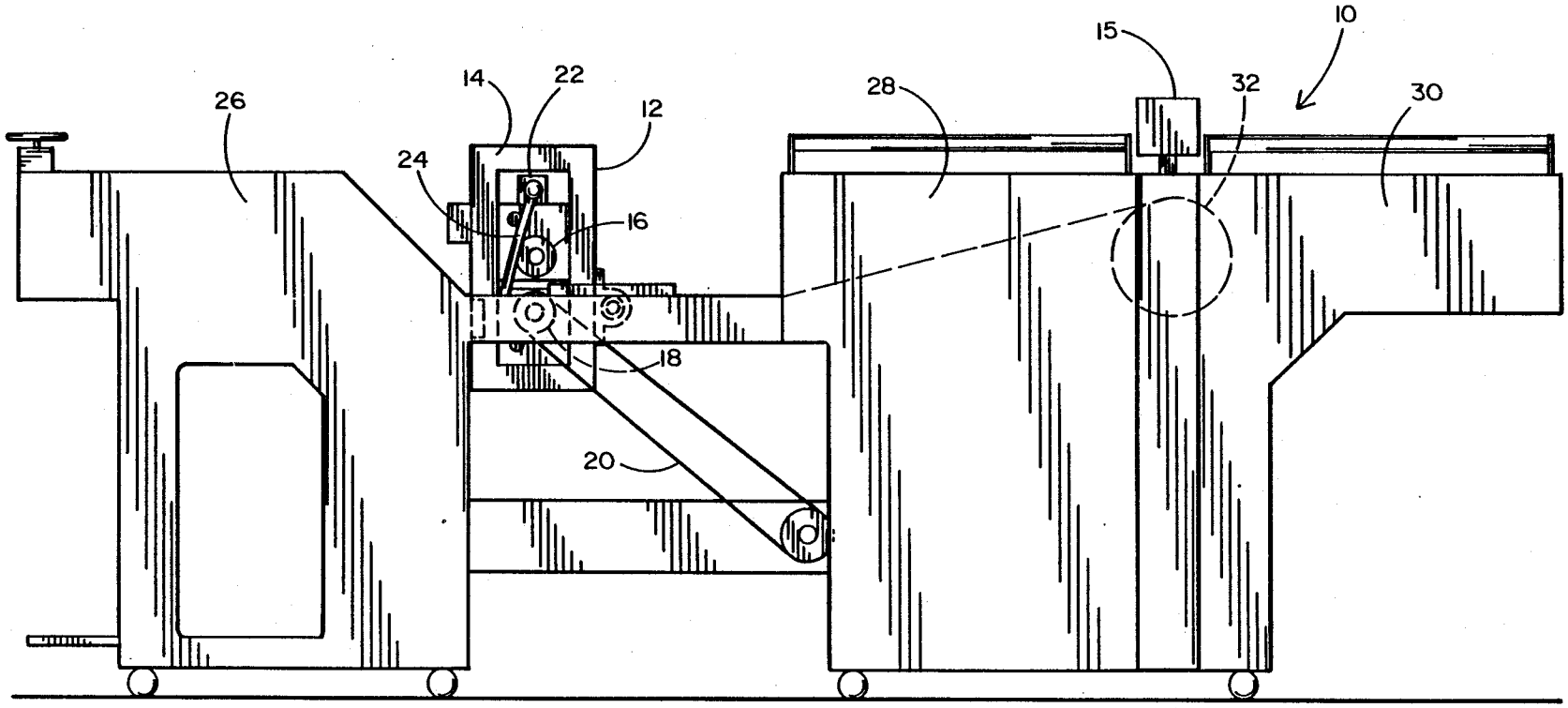
FIG. 1 is a side view of a screen process printing machine with the present invention installed therein.

Referring now to FIG. 1, it will be seen that the screen process printing machine 10 shown therein utilizes a crush roller assembly 12 of the present invention which is placed strategically between a first feeder 26 for feeding sheets to the crush roller assembly 12 and a conveyor 28 designed to feed sheets to the screen printer and more specifically to the cylinder 32 and screen printing actuator 15. As seen further in FIG. 1, crush roller assembly 12 comprises a roller assembly frame 14 which houses a lower crush roller 18 and an upper crush roller 16. The lower crush roller 18 is a driven roller, driven by a chain drive 20. On the other hand, upper crush roller 16 is meshed by gears which rolls as a result of surface and gear friction between it and the lower crush roller 18. In order to impart such friction in the rollers and also to apply the lithographic powder crushing forces developed therein, the upper crush roller 16 is made to be slideable within roller assembly frame 14 by means of a hydraulic ram 22. Hydraulic fluid is supplied to ram 22 at connector 35 by a hydraulic hose 24 connected to a suitable hydraulic pressure source (not shown).

Paper flow through the screen process printing machine 10 and the crush roller assembly 12 thereof occurs from left to right as seen in FIG. 1. Sheets are first fed by crusher feeder 26 through the crush roller assembly 12 between the two rollers 16 and 18 with the lower roller rotating as a result of the movement of chain drive 20 and the upper roller rotating in the opposite direction as a result of the gear mesh between it and the lower roller 18 with the hydraulic ram 22 compressing the upper roller against the lower. Paper sheets with lithographic powder are thus compressed between the rollers 16 and 18 as they pass therethrough and are fed onto conveyor of the screen printer portion of the machine 10 and eventually onto cylinder 32 where they are rotated in synchronism with the movement of a screen frame actuator 15 and eventually off loaded onto output table 30 at the right-most portion of FIG. 1.

Figure 2:
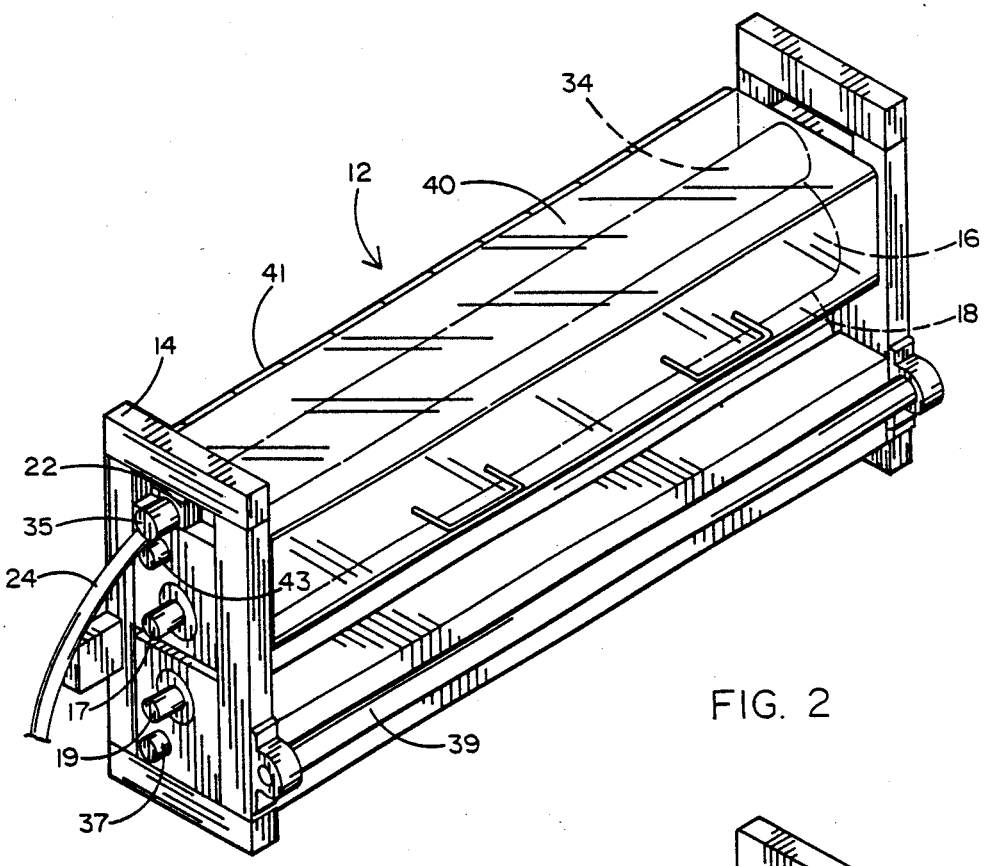
FIG. 2 is an isometric view of the present invention taken from the outfeed side thereof.
Figure 3:
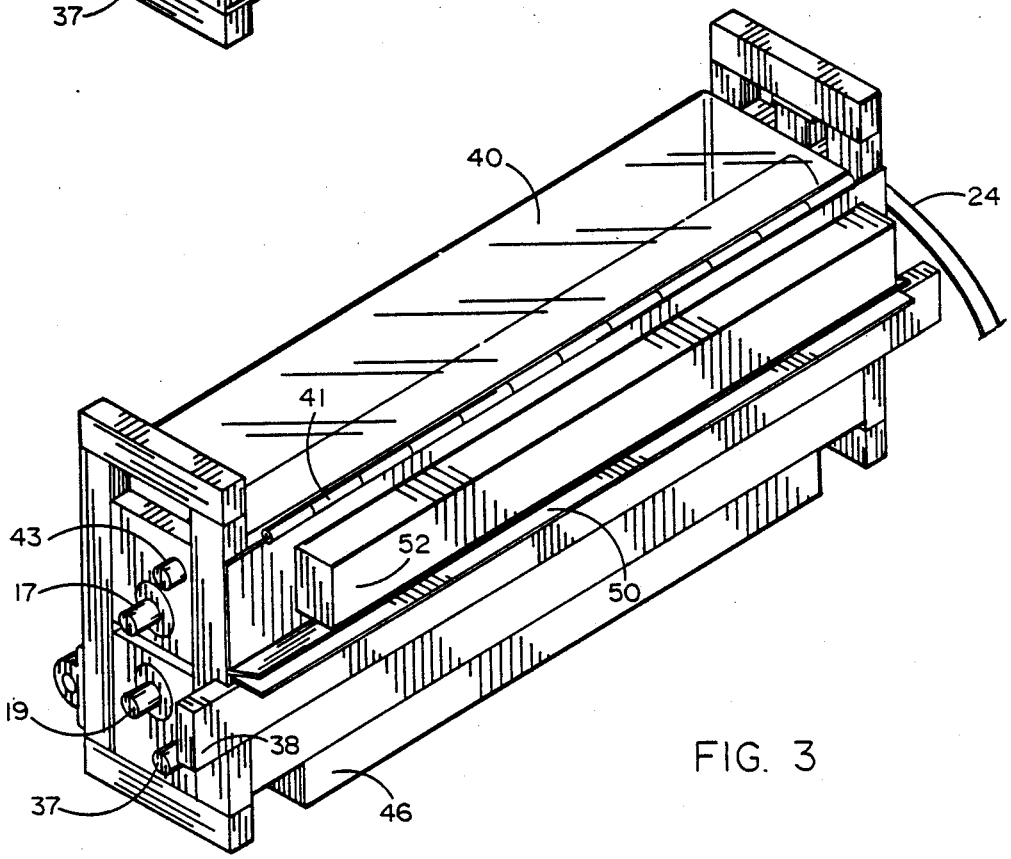
FIG. 3 is an isometric view of the present invention taken from the infeed side thereof.
Figure 4:
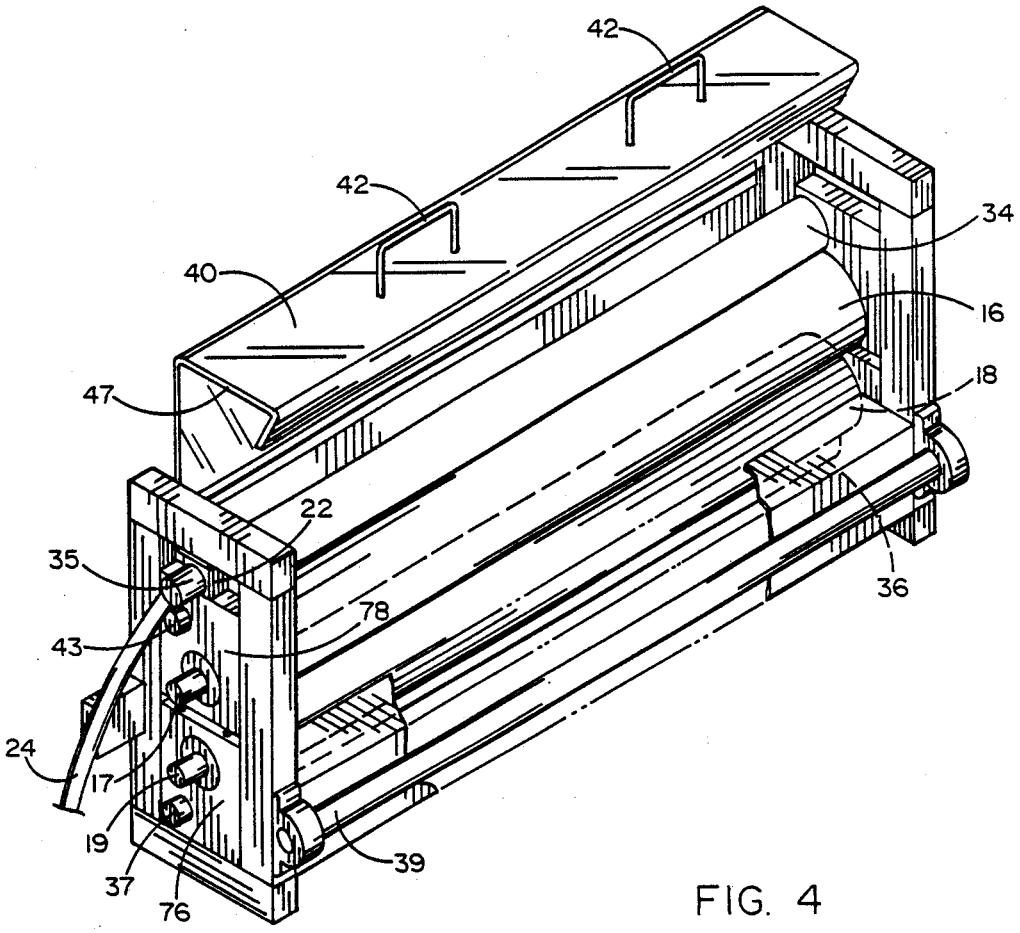
FIG. 4 is an isometric drawing of the invention, similar to that of FIG. 2 but showing the housing thereof in its open configuration.
Figure 5:
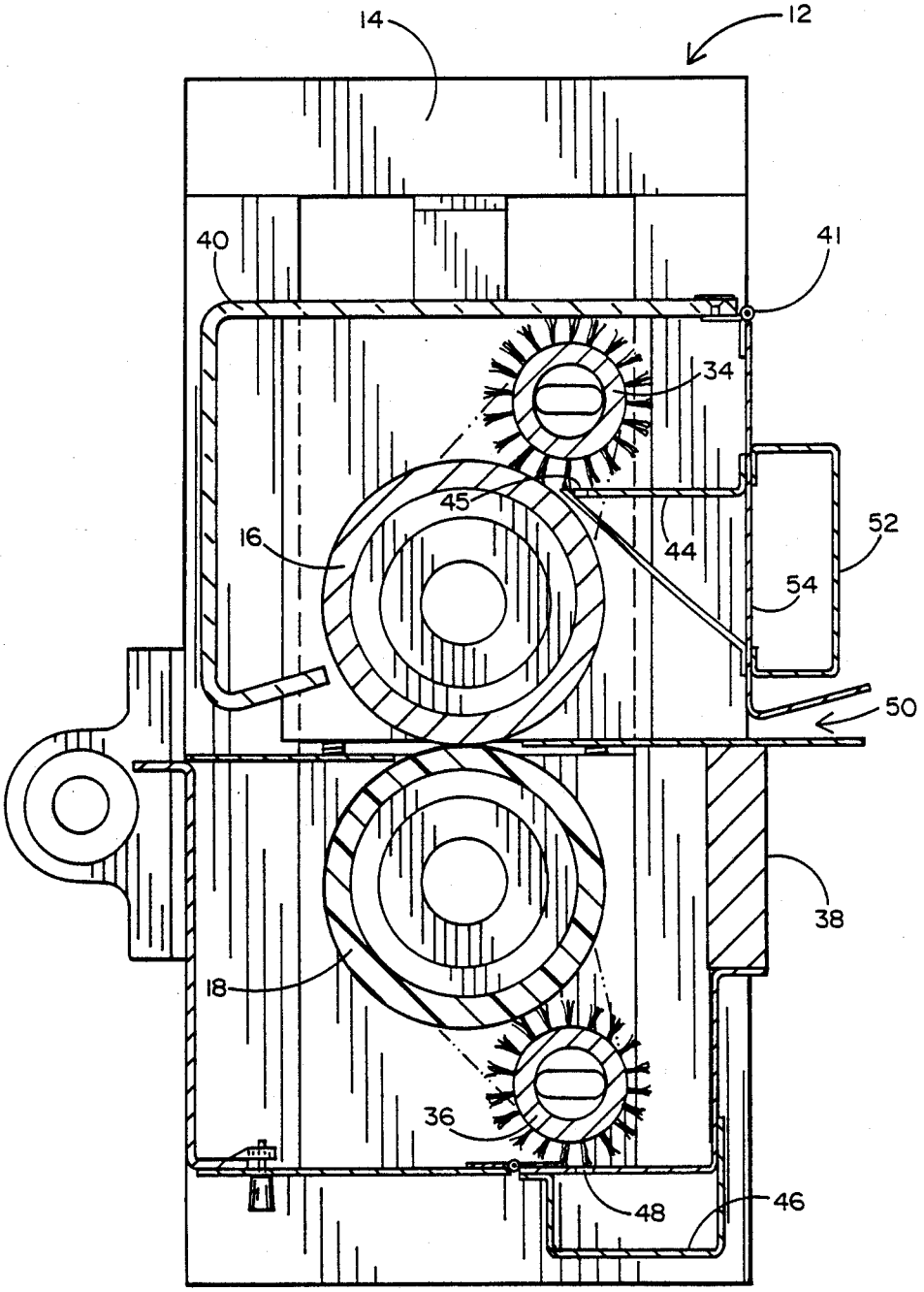
FIG. 5 is a cross-sectional view of the present invention.

Reference will now be made FIGS. 2 through 5 which illustrate in detail the features of the crush roller assembly of the present invention. More specifically referring now to FIGS. 2 through 5 it will be seen that the crush roller assembly 12 comprises a roller assembly frame 14 across which are positioned the four rollers of the assembly. More specifically, as seen best in FIG. 4, in addition to the crusher rollers 16 and 18 previously mentioned, the crush roller assembly 12 of the present invention also provides an upper brush roller 34 and a lower brush roller 36. As will be seen in FIG. 5, brush rollers 34 and 36 contain a bristle brush surface and each is in contact with its respective crusher roller 16 and 18. Each of the rollers 16, 18, 34 and 36 is mounted on a corresponding shaft which spans the full length of the roller assembly frame 14 as seen in FIGS. 2 through 4. Upper crusher roller 16 is provided with a shaft 17, lower crusher roller 18 is provided a shaft 19, upper brush roller 34 is provided with a shaft 43 and lower brush roller 36 is provided with a shaft 37. Roller assembly 12 is also provided with a housing 40 which provides a top hinged cover 47, the latter providing a pair of handles 42 for rotatably opening the hinge cover 47 about an elongated array of hinges 41. Hinged cover 47, in conjunction with the remaining portions of housing 40, serves a dual purpose. The first such purpose is to safety enclose the rollers of the assembly 12 so that during operation there is virtually no likelihood of any injury due to inadvertent contact by personnel with the rollers. A second important purpose of the housing and hinged cover is to enclose the roller assembly to an extend which permits the establishment of a partial vacuum within the housing 40 and particularly adjacent the brush rollers 34 and 36. Such vacuum is provided by connecting a pair of plenums, namely, a lower plenum 46 and an upper plenum 52, to a suitable vacuum source through appropriate hoses. As seen best in FIG. 5, lower plenum 46 is positioned along the lower input side of the housing 40 adjacent to the lower brush roller 36 and is provided with a linear array of holes 48 which allow a negative pressure to be applied immediately adjacent to the bristles of lower brush roller 36. Similarly, upper plenum 52 is connected to the housing 40 adjacent to the upper brush roller 34. However in this case, a suction bracket 44, inside the housing 40 and of triangular configuration is also provided in order to place a similar linear array of holes 45 adjacent to the bristles of upper brush roller 34. An additional array of holes 54 is provided between the plenum 52 and the suction bracket 44 in order to channel any vacuumed powder from the upper roller 34 through the suction bracket 44 and into the upper plenum 52. The plenums would, of course, be provided with a suitable outlet to a vacuum hose which has been omitted in the drawings to avoid obfuscation of the inventive structure. This novel configuration of a substantially enclosed housing and vacuum or suction plenums positioned adjacent the brush rollers which are in turn positioned to remove crushed powder from the crusher rollers 16 and 18, respectively, substantially reduces the need for periodic cleaning of the rollers of crush roller assembly 12. The present invention obviates to a substantial degree, the frequent and costly down time maintenance required of more conventional crusher roller configurations of the prior art.

Crush roller assembly 12 is also provided with a support plate 38 which is firmly affixed to the roller assembly frame 14 and extends laterally thereof to provide a suitable mechanical interface with a screen process printing machine 10. Also provided is a sheet inlet 50, seen best in FIG. 5 and a sheet output conveyor 39, seen best in FIGS. 2 and 4.

Figure 6:
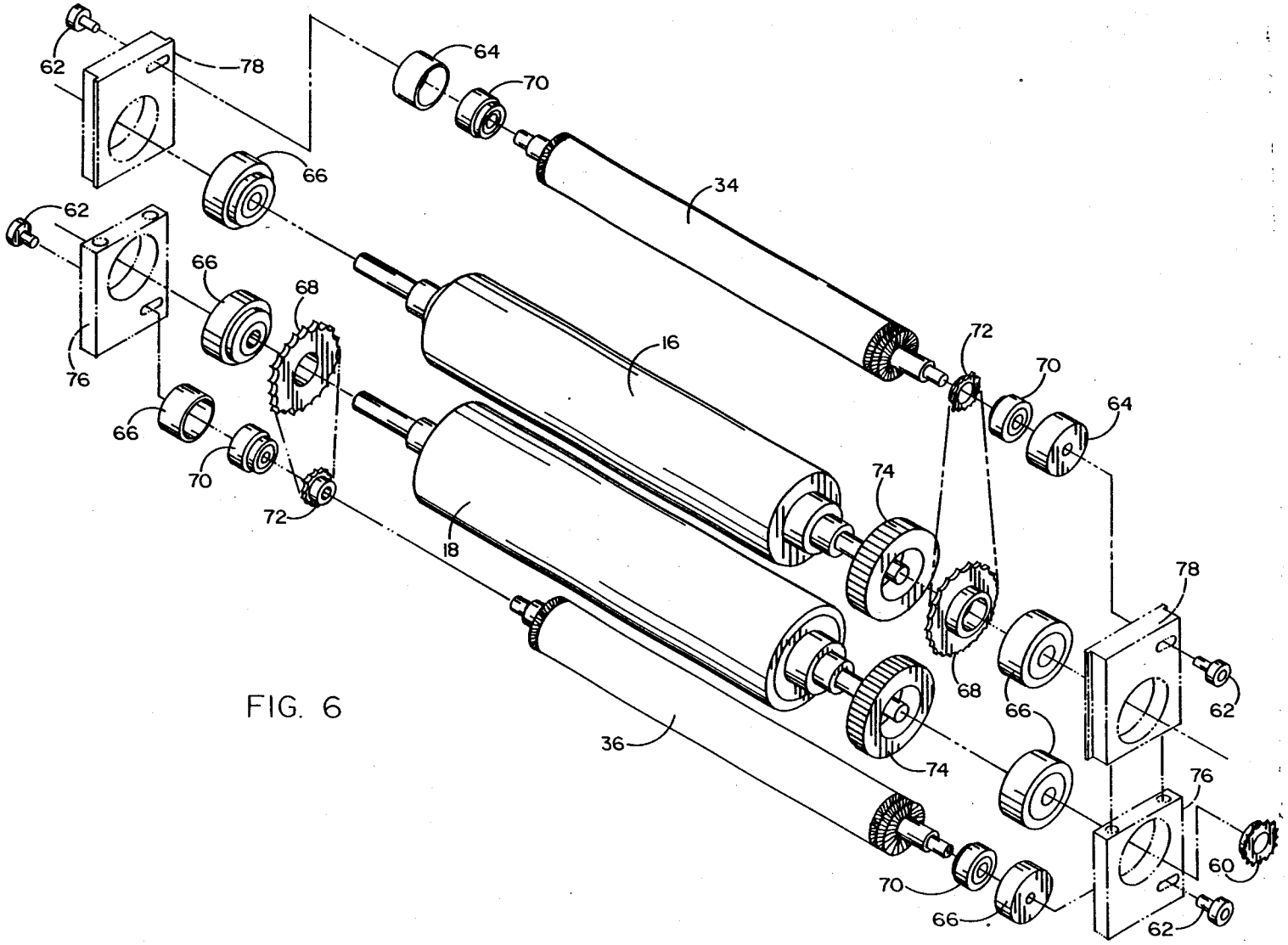
FIG. 6 is an exploded view of the roller assembly portion of the present invention.

Reference will now be made to FIG. 6 which provides a detailed exploded view of the roller interface configuration of assembly 12. More specifically referring now to FIG. 6, it will be seen that the assembly provides a lower crush roller drive sprocket 60, a pair of slide bushings 62, bearing holders 64 and 66, bearings 70, sprockets 68 and 72, sprockets 72, gears 74, a pair of crush roller blocks 76 which are stationary and located on each axial end of lower crush roller 18 and a pair of crush roller slide blocks 78 which are positioned on each axial end of upper crush roller 16. Chain drive 20 of FIG. 1 drives sprocket 60 which in turn rotates lower crush roller 18. When the upper crush roller 16 is lowered and placed in engagement with lower crush roller 18 by means of hydraulic ram 22, gears 74 on one side of the respective rollers 16 and 18, engage and also provide the rotational drive transfer from lower crush roller 18 to upper crush roller 16. Simultaneously, sprockets 68 are rotated and in turn, rotate corresponding sprockets 72 thereby engaging the brush rollers 34 and 36 with their respective crush rollers 16 and 18, respectively.

It will now be understood that what has been disclosed herein comprises a novel crush roller assembly for integration with a screen process printing machine. The assembly comprises upper and lower crush rollers each associated with a corresponding brush roller and all contained within a housing for enabling the application of a partial vacuum through corresponding brush roller plenums to effectively automate at least the majority of the crush powder removal from the brush rollers during use. Furthermore, it will be seen that the housing of the present invention also provides a selectively openable hinged cover which, while enabling access to the rollers of the invention, also secures the rollers within an enclosure to prevent inadvertent contact between operating personnel and the roller assembly which might otherwise result in injury. In addition to the unique maintenance reducing feature of the present invention, a significant advantage of the invention resides in its integration into a screen process printing machine which permits crushing and removal of agglomerated lithographic printing powder that might otherwise interfere with screen process coating taking place immediately after the sheets are fed through the roller assembly of the invention.

Those having skill in the art to which the present invention pertains will, as a result of the applicants' teaching herein, perceive various modifications and additions which may be made to the invention. By way of example, other specific sizes and relative positions and orientations of the rollers of the present invention, as well as other shapes and configurations of the housing in which the rollers are contained, and other means for applying a vacuum pressure thereto in order to reduce the maintenance requirements thereof will now occur to artisans of relevant skill having the benefit of the disclosure herein. Accordingly all such modifications and additions are deemed to be within the scope of the invention which is to be limited only by the claims appended hereto.

We claim:

1. In a screen process printing machine a crush roller apparatus comprising:

a pair of selectively engageable adjacent crush roller oriented on parallel axes;

a pair of brush rollers, each such brush roller having brush bristles in contact with the radial surface of a respective crush roller for wiping the surface of the crush roller, a housing for enclosing said crush rollers and said brush rollers, a frame supporting said housing, said crush rollers and said brush rollers on said screen process printing machine in a location for crushing agglomerated powder on sheets being fed to said machine for printing;

a pair of fixed blocks supporting the axial ends of one of said crush rollers and a pair of slideable blocks supporting the axial ends of the other of said crush rollers for sliding engagement with said frame; and a selectively enabled actuator for sliding said slideable blocks toward and away from said fixed blocks whereby said crush rollers are selectively engaged and disengaged with respect to one another.

2. The crush roller apparatus recited in claim 4 further comprising:

means for providing a suction effect adjacent each of said brush rollers for automatically removing crushed powder therefrom.

3. The crush roller apparatus recited in claim 2 wherein said suction effect means comprises a plenum adjacent each said brush roller, each said plenum having a plurality of apertures for drawing powder therethrough from said brush roller into the plenum.

4. The crush roller apparatus recited in claim 1 wherein said actuator comprises a hydraulic ram affixed to said frame and having a moveable member affixed to at least one of said slidable blocks, said ram being responsive to hydraulic fluid pressure.

5. The crush roller apparatus recited in claim 1 wherein said housing comprises a hinged cover providing access to said crush rollers when said cover is opened and preventing access to said crush rollers when said cover is closed.

6. The crush roller apparatus recited in claim 1 wherein each of said crush rollers comprises a non-compressible radial surface.

* * * * *